US011114791B1

(12) United States Patent
Lee

(10) Patent No.: US 11,114,791 B1
(45) Date of Patent: Sep. 7, 2021

(54) CONNECTOR

(71) Applicant: CHICONY POWER TECHNOLOGY CO., LTD., New Taipei (TW)

(72) Inventor: Po-Sheng Lee, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/878,839

(22) Filed: May 20, 2020

(30) Foreign Application Priority Data

Feb. 25, 2020 (TW) ..... 109106117

(51) Int. Cl.
*H01R 13/405* (2006.01)
*H01R 24/20* (2011.01)

(52) U.S. Cl.
CPC ..... *H01R 13/405* (2013.01); *H01R 24/20* (2013.01)

(58) Field of Classification Search
CPC ..... H01R 13/405
USPC ..... 439/606
See application file for complete search history.

(56) References Cited

U.S. PATENT DOCUMENTS 4,433,206 A * 2/1984 Lewis ..... H01R 13/6592 174/359
4,737,124 A * 4/1988 Ezure ..... H01R 24/86 439/607.41
5,278,357 A * 1/1994 Yamanashi ..... F16H 57/04 174/151
5,429,697 A * 7/1995 Lilienthal, II ..... B29C 70/683 156/145
5,630,732 A * 5/1997 Yamanashi ..... H01R 13/5216 439/589
5,658,170 A * 8/1997 Tan ..... H01R 9/034 439/607.41

(Continued)

FOREIGN PATENT DOCUMENTS

CN 2893966 Y 4/2007
CN 204179445 U 2/2015

(Continued)

OTHER PUBLICATIONS

Office Action dated Nov. 6, 2020 in TW Application No. 109106117 (9 pages).

*Primary Examiner* — Neil Abrams
(74) *Attorney, Agent, or Firm* — Muncy, Geissler, Olds & Lowe, P.C.

(57) ABSTRACT

A connector includes a main body, a terminal module, a cable module, a housing and an insulating material. The main body has a first opening and a second opening. The terminal module includes a terminal portion and an insulating portion partially covering the terminal portion. The terminal portion includes plural terminals protruding beyond one side of the insulating portion, a middle portion covered by the insulating portion, and a pin portion exposed from the opposite side of the insulating portion. The cable module has a connecting portion electrically connected to the pin portion. The housing covers the main body and the terminals. The housing has an end portion disposed adjacent to the insulating portion. The end portion is configured with plural third openings. The insulating material which may be poured through the third openings covers the end portion, the connecting portion, the pin portion and the insulating portion, and fills the third openings.

18 Claims, 9 Drawing Sheets

(56) References Cited

U.S. PATENT DOCUMENTS

| | | | | |
|---|---|---|---|---|
| 5,879,196 | A * | 3/1999 | Lee | H01R 13/504 439/660 |
| 6,585,536 | B1 * | 7/2003 | Wu | H01R 13/6275 439/358 |
| 7,033,193 | B2 * | 4/2006 | Higgins | H01R 13/5219 439/277 |
| 7,048,563 | B2 * | 5/2006 | Fukuda | H01R 13/5216 439/274 |
| 8,039,746 | B2 * | 10/2011 | Ashida | H01R 13/5216 174/88 R |
| 8,277,250 | B2 * | 10/2012 | Suzuki | H01R 13/504 439/604 |
| 8,752,286 | B2 * | 6/2014 | Kataoka | H01R 13/5216 29/857 |
| 8,808,035 | B2 * | 8/2014 | Wu | H01R 24/58 439/668 |
| 8,851,925 | B2 * | 10/2014 | Kataoka | H01R 13/405 439/604 |
| 9,306,314 | B2 * | 4/2016 | Wu | H01R 13/504 |
| 9,761,988 | B1 * | 9/2017 | Lin | H01R 13/5216 |
| 10,276,972 | B1 * | 4/2019 | Lai | H01R 13/5216 |
| 10,381,785 | B2 | 8/2019 | Maesoba et al. | |
| 10,476,189 | B2 * | 11/2019 | Tsubaki | H01R 12/774 |
| 11,011,866 | B2 * | 5/2021 | Suzuki | H01R 43/24 |
| 2008/0009189 | A1 | 1/2008 | Wu | |
| 2009/0117784 | A1 | 5/2009 | Wu | |
| 2014/0073201 | A1 * | 3/2014 | Weber | H01R 13/405 439/736 |
| 2014/0370755 | A1 * | 12/2014 | Endo | H01R 43/18 439/625 |
| 2016/0013581 | A1 | 1/2016 | Wu et al. | |
| 2018/0040969 | A1 | 2/2018 | Wu et al. | |

FOREIGN PATENT DOCUMENTS

| | | | |
|---|---|---|---|
| CN | 105375231 | A | 3/2016 |
| CN | 205657277 | U | 10/2016 |
| CN | 205724158 | U | 11/2016 |
| CN | 106505370 | A | 3/2017 |
| CN | 206148720 | U | 5/2017 |
| CN | 206353639 | U | 7/2017 |
| CN | 206370542 | U | 8/2017 |
| CN | 206480831 | U | 9/2017 |
| CN | 107689507 | A | 2/2018 |
| CN | 207530222 | U | 6/2018 |
| TW | M-324882 | U | 1/2008 |

* cited by examiner

CONNECTOR

CROSS REFERENCE TO RELATED APPLICATIONS

This Non-provisional application claims priority under 35 U.S.C. § 119(a) on Patent Application No(s). 109106117 filed in Taiwan, Republic of China on Feb. 25, 2020, the entire contents of which are hereby incorporated by reference.

BACKGROUND

Technology Field

This disclosure relates to a connector and, in particular, to a connector that can save the assembling cost.

Description of Related Art

In order to prevent the external stress, especially the lateral force, from causing the bending and thus detaching between the housing and the insulating material, the conventional connector is usually configured with an iron shell to cover the housing for enhancing the binding of the housing and the insulating material. Referring to FIG. 5, the iron shell 21 is fixed to the housing 22 by welding or wedging at the fixing positions 211, and then the insulating material 23 is filled inside the iron shell 21 by injection molding. Finally, the coating 24 is provided to cover the iron shell 21, thereby finishing the fabrication of the connector 2. Although this approach can enhance the connection between the housing 22 and the insulating material 23 so as to prevent the deformation and detachment caused by the external forces F (arrows as shown in FIG. 5), the additional component (the iron shell 21) is required. However, the configuration of the additional component needs additional assembling process, which may increase the manufacturing cost of the connector, decrease the production efficiency, or cause short circuits between the terminals inside the iron shell and the connector by unintentional assembling error.

Therefore, it is desired to provide a connector that can enhance the connection between the housing and the insulating material without the additional component, thereby preventing the bending and thus detaching between the housing and the insulating material caused by the lateral force.

SUMMARY

An objective of this disclosure is to provide a connector. Compared with the conventional art, the connector of this disclosure does not need the additional component for enhancing the connection between the housing and the insulating material, thereby saving the manufacturing cost, increasing the production efficiency, and improving the reliability of the connector.

To achieve the above, this disclosure provides a connector, which comprises a main body, a terminal module, a cable module, a housing, and an insulating material. The main body comprises a first opening and a second opening. The terminal module comprises a terminal portion and an insulating portion, which partially covers the terminal portion. The terminal portion comprises a plurality of terminals, a middle portion and a pin portion. The terminals protrude beyond one side of the insulating portion, the middle portion is covered by the insulating portion, and the pin portion is exposed from another side of the insulating portion opposite to the side of the insulating portion. The insulating portion is disposed adjacent to the second opening and connected to the main body, and the terminals are disposed in the main body and exposed from the first opening. The cable module comprises a connecting portion electrically connected to the pin portion. The housing covers the main body and the terminals. The housing has an end portion disposed adjacent to the insulating portion, and the end portion is configured with a plurality of third openings. The insulating material covers the end portion, the connecting portion, the pin portion and the insulating portion, and the insulating material further fills the third openings.

In one embodiment, the insulating portion further comprises a recess portion, and the pin portion is disposed in the recess portion.

In one embodiment, the insulating material further fills the recess portion.

In one embodiment, the connector further comprises a cover skin covering the insulating material.

In one embodiment, the third openings are disposed on an upper surface and/or a lower surface of the end portion.

In one embodiment, the third openings are further disposed on at least one of two side surfaces of the end portion, and the side surfaces connect to the upper surface and the lower surface.

In one embodiment, the third openings are arranged at the end portion in parallel.

In one embodiment, the third openings are linearly arranged at the end portion along a direction.

In one embodiment, the third openings are arranged in a staggered manner at the end portion.

In one embodiment, the third openings are circular, triangular, rectangular, polygonal, long stripes, or a combination thereof.

In one embodiment, when the third openings are long stripes, the extension directions of the third openings are the same.

In one embodiment, at least one of the third openings has a shape, a size, and/or an extension direction different from that of the other third openings.

As mentioned above, the connector of this disclosure is to configure a third opening on the housing instead of utilizing the additional component. The insulating material can be filled in the third opening and cover a part of the housing, thereby enhancing the connection between the insulating material and the housing. Accordingly, the manufacturing cost of the connector can be decreased, the production efficiency thereof can be increased, and the reliability thereof can be improved.

BRIEF DESCRIPTION OF THE DRAWINGS

The disclosure will become more fully understood from the detailed description and accompanying drawings, which are given for illustration only, and thus are not limitative of the present disclosure, and wherein.

DETAILED DESCRIPTION OF THE DISCLOSURE

The present disclosure will be apparent from the following detailed description, which proceeds with reference to the accompanying drawings, wherein the same references relate to the same elements.

The connector of this disclosure is to configure a third opening on the housing, and the insulating material is filled in the third opening, thereby enhancing the connection between the insulating material and the housing. Accordingly, the manufacturing cost of the connector can be decreased, the production efficiency thereof can be increased, and the reliability thereof can be improved.

Figure 1A:
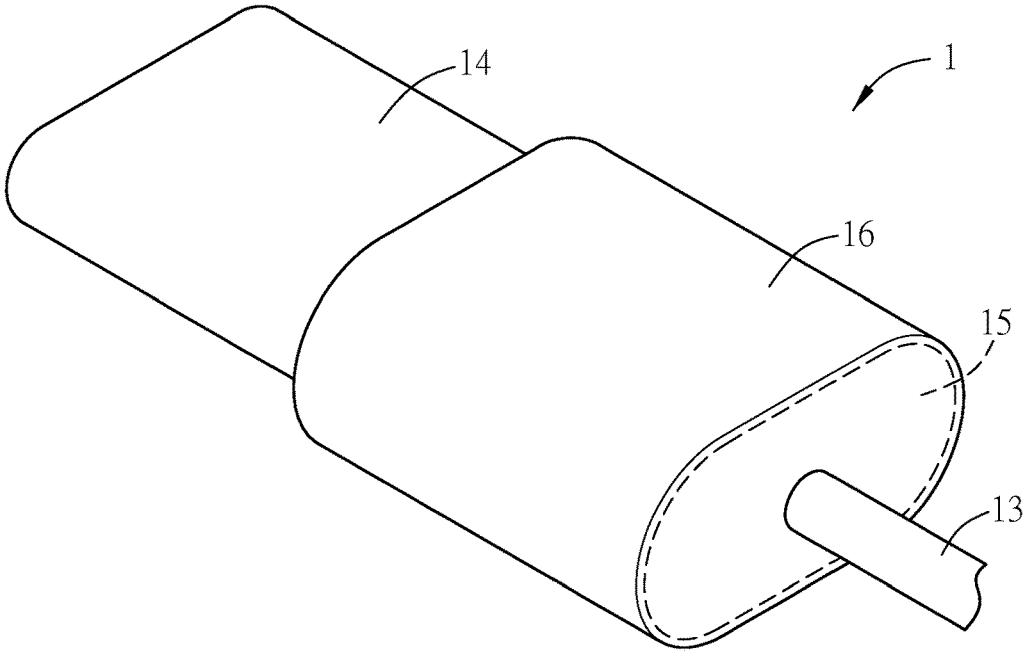
FIG. 1A is a schematic diagram showing a connector according to an embodiment of this disclosure.
Figure 1B:
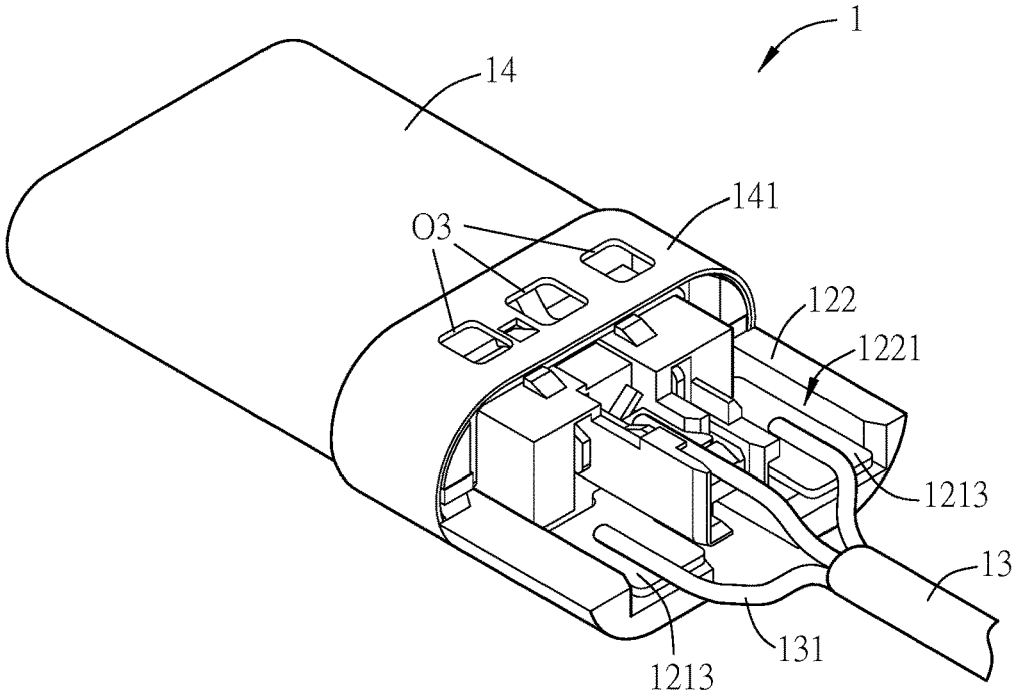
FIG. 1B is a schematic diagram showing the main body, the terminal module, the cable module and the housing of the connector of this disclosure.
Figure 1C:
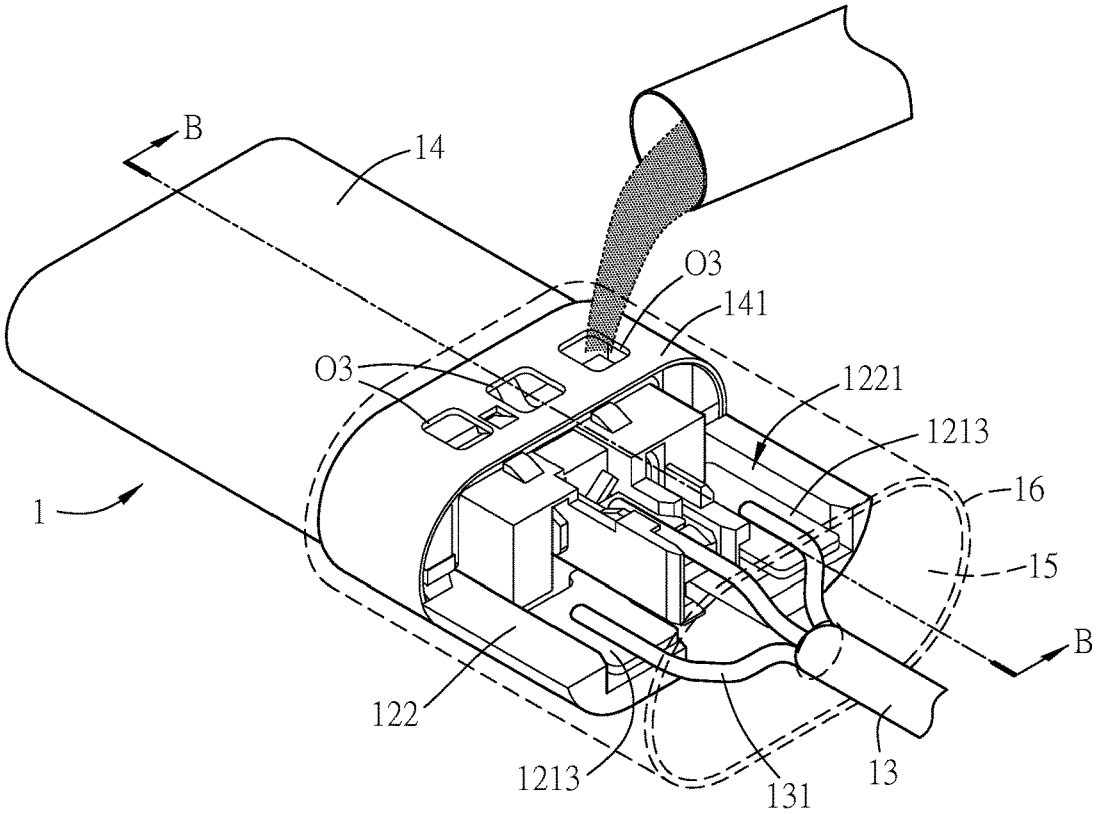
FIG. 1C is a schematic diagram showing the process of filling the insulating material of the connector of FIG. 1B.
Figure 1D:
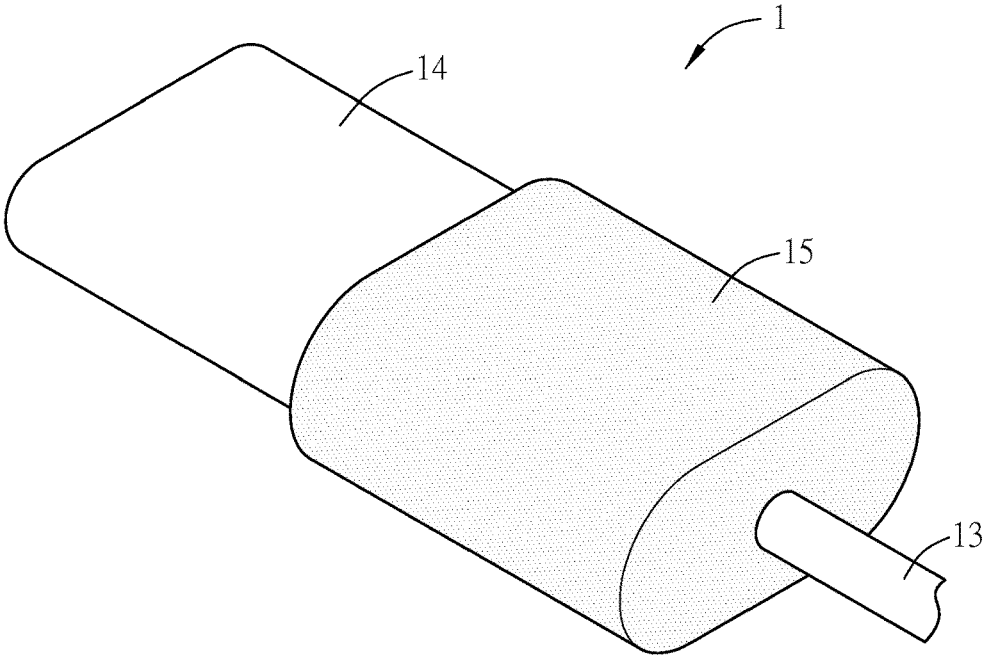
FIG. 1D is a schematic diagram showing the connector after filling the insulating material as shown in FIG. 1C.
Figure 2A:
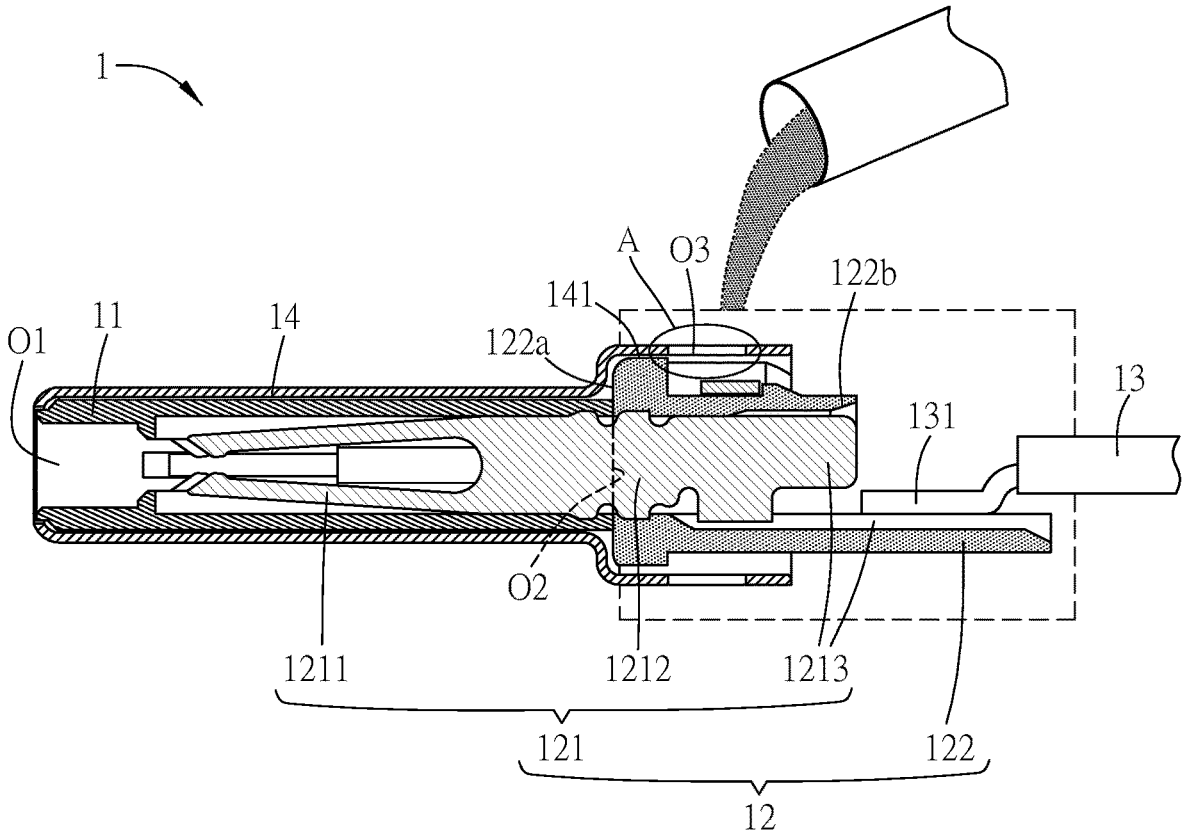
FIG. 2A is a sectional view of the connector as shown in FIG. 1C along the line B-B.
Figure 2B:
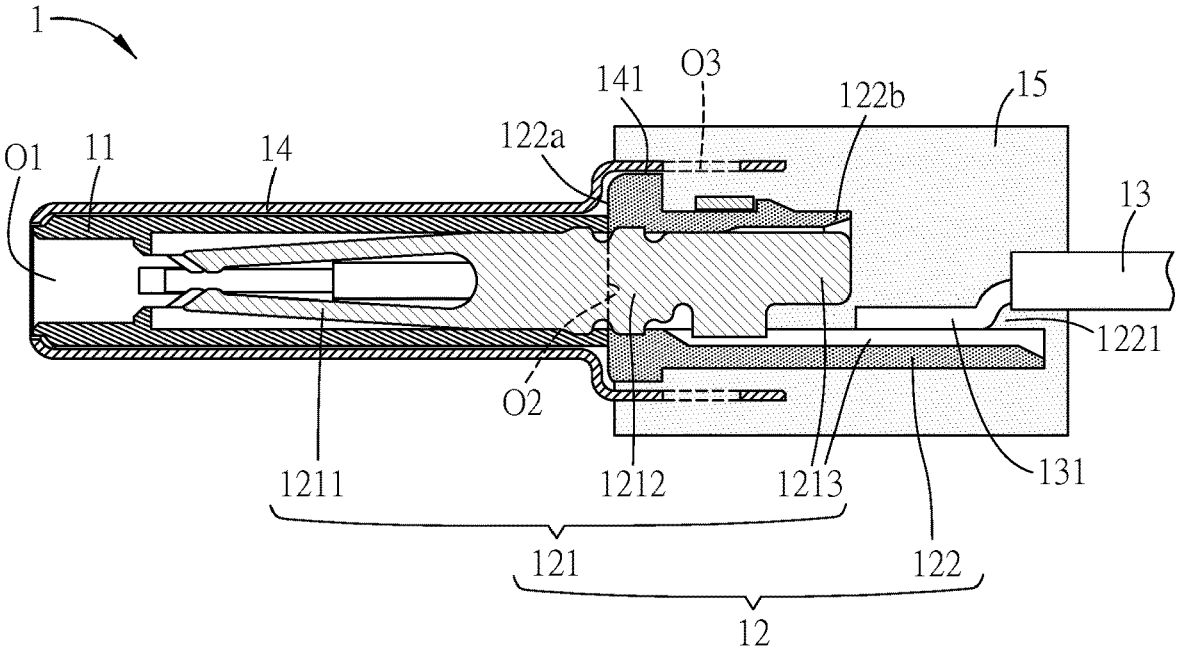
FIG. 2B is a sectional view of the connector as shown in FIG. 2A added with the insulating material.

FIG. 1B is a schematic diagram showing the main body, the terminal module, the cable module and the housing of the connector of this disclosure, FIG. 1C is a schematic diagram showing the process of filling the insulating material of the connector of FIG. 1B, FIG. 1D is a schematic diagram showing the connector after filling the insulating material as shown in FIG. 1C, FIG. 2A is a sectional view of the connector as shown in FIG. 1C along the line B-B, and FIG. 2B is a sectional view of the connector as shown in FIG. 2A added with the insulating material. Referring to FIGS. 1B and 2B, the connector 1 of this embodiment comprises a main body 11, a terminal module 12, a cable module 13, a housing 14, and an insulating material 15. The main body 11 comprises a first opening O1 and a second opening O2. The terminal module 12 comprises a terminal portion 121 and an insulating portion 122, which partially covers the terminal portion 121. The terminal portion 121 comprises a plurality of terminals 1211, a middle portion 1212, and a pin portion 1213. The terminals 1211 protrude beyond one side 122*a* of the insulating portion 122, the middle portion 1212 is covered by the insulating portion 122, and the pin portion 1213 is exposed from another side 122*b* of the insulating portion 122 opposite to the side 122*a*. The insulating portion 122 is disposed adjacent to the second opening O2 and connected to the main body 11, and the terminals 1211 are disposed in the main body 11 and exposed from the first opening O1. The cable module 13 comprises a connecting portion 131 electrically connected to the pin portion 1213. The housing 14 covers the main body 11 and the terminals 1211. The housing 14 has an end portion 141 disposed adjacent to the insulating portion 122, and the end portion 141 is configured with a plurality of third openings O3. The insulating material 15 covers the end portion 141, the connecting portion 131, the pin portion 1213, and the insulating portion 122, and the insulating material 15 further fills the third openings O3. The design of providing the insulating material 15 to pass through the third opening O3 and fill the third opening O3 can enhance the connection between the insulating material 15 and the end portion 141. In particular, the insulating material 15 can be formed by, for example but not limited to, injection molding or any of other known technologies to cover the end portion 141, the connecting portion 131, the pin portion 1213, and the insulating portion 122, and then to fill the third openings O3. The insulating material 15 can be made by, for example but not limited to, PP, PVC, PE, or any of other suitable materials (easy to mold and solid). The electrically connection between the connecting portion 131 and the pin portion 1213 can be, for example but not limited to, welding or any of other known technologies.

Referring to FIGS. 1B and 2B, in this embodiment, the insulating portion 122 further comprises a recess portion 1221, and the pin portion 1213 is disposed in the recess portion 1221. The insulating material 15 is further filled in the recess portion 1221.

Figure 2C:
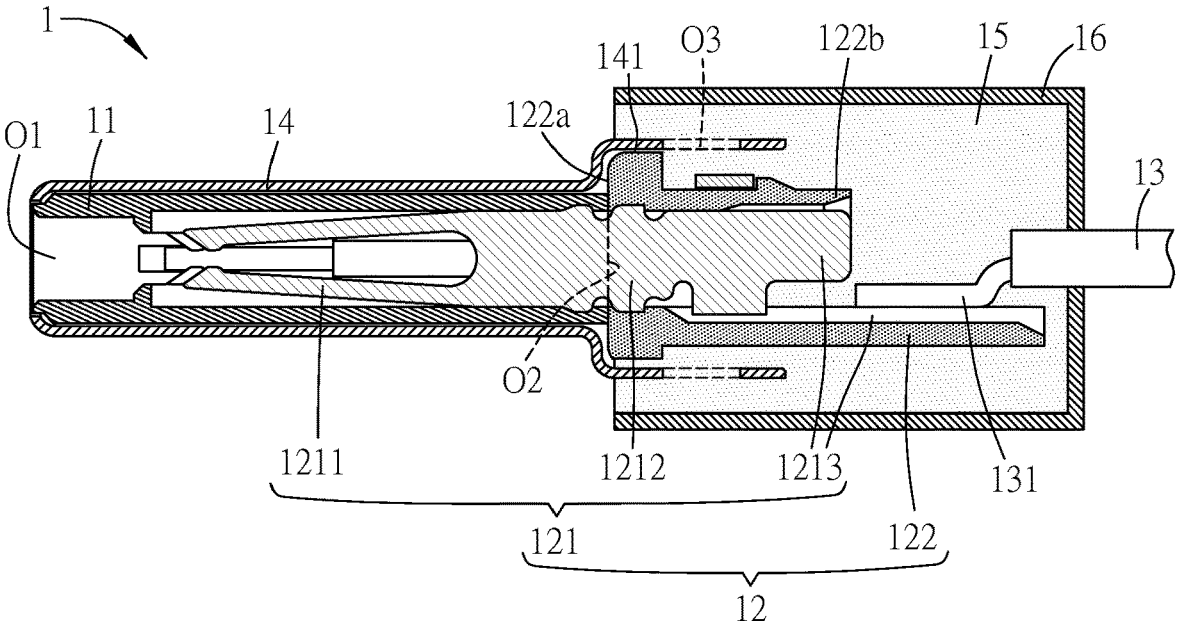
FIG. 2C is a sectional view of the connector as shown in FIG. 2B added with the coating.

FIG. 1A is a schematic diagram showing the connector according to an embodiment of this disclosure, and FIG. 2C is a sectional view of the connector as shown in FIG. 2B added with the coating. In this embodiment, the connector 1 further comprises a cover skin 16 covering the insulating material 15. The cover skin 16 can be made of a plastic material to provide a fancy or good looking for the connector 1.

Figure 3A:
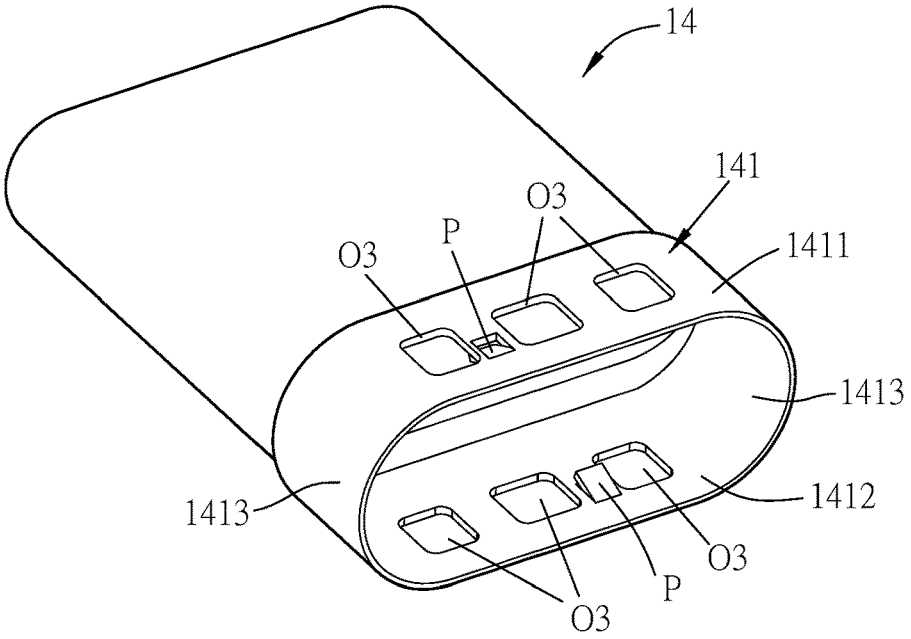
FIGS. 3A to 3E are schematic diagrams showing different aspects of the third opening of the connector of this disclosure.
Figure 3B:
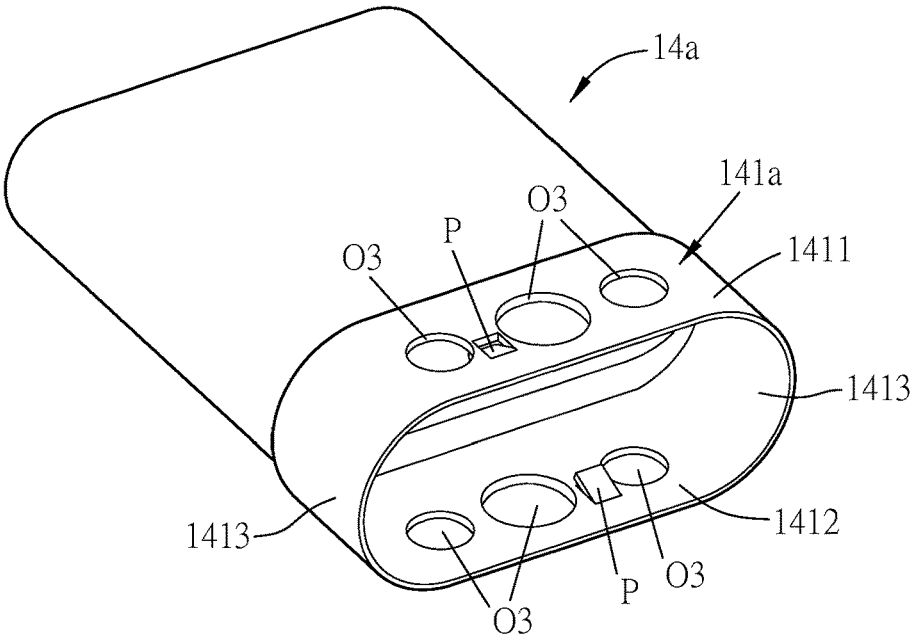
Figure 3C:
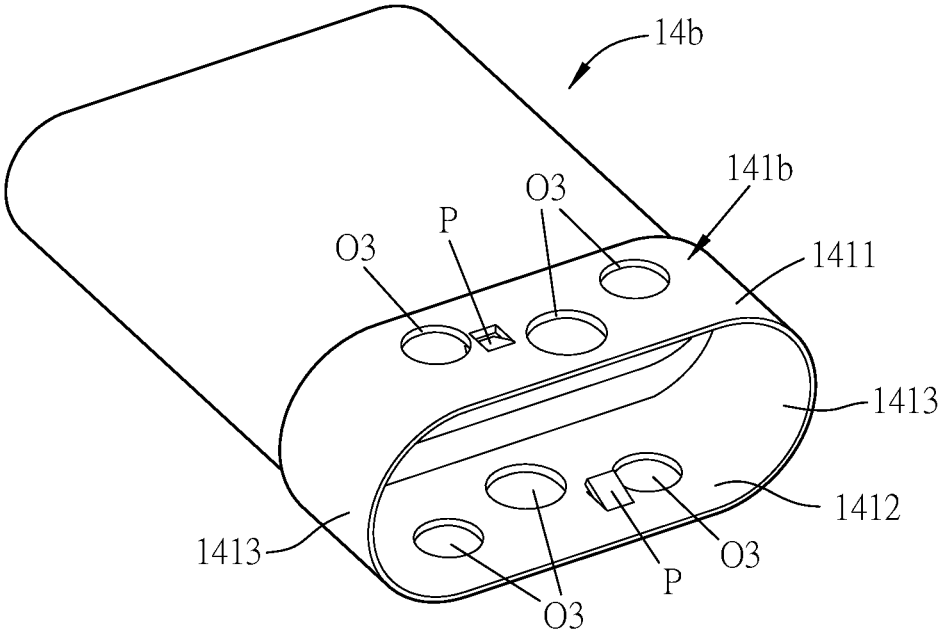
Figure 3D:
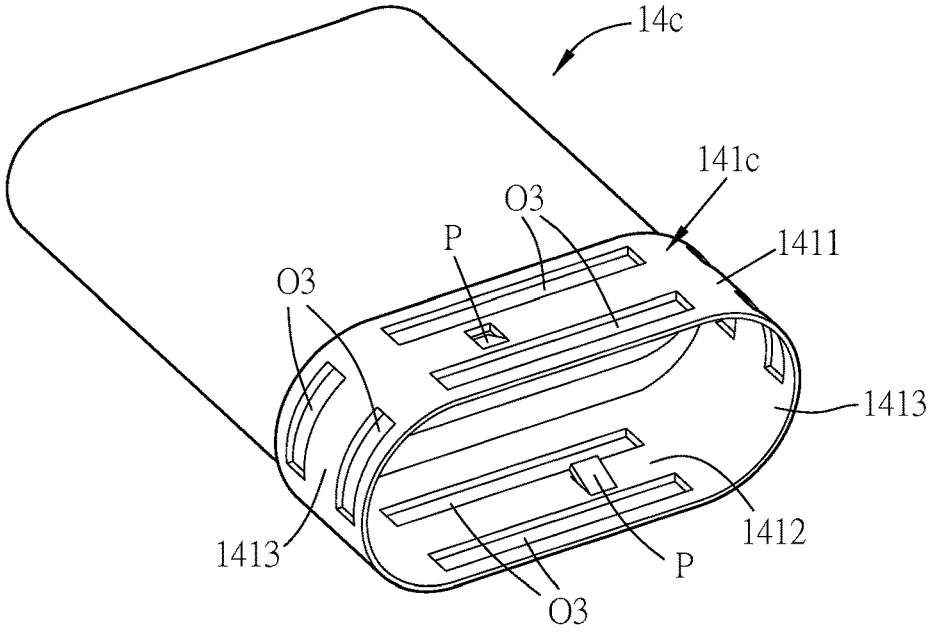

FIGS. 3A to 3E are schematic diagrams showing different aspects of the third opening of the connector of this disclosure. Referring to FIGS. 3A to 3D, in this embodiment, the third openings O3 are disposed on an upper surface 1411 and/or a lower surface 1412 of the end portion 141, 141*a*, 141*b* or 141*c* of the housing 14, 14*a*, 14*b* or 14*c*. As shown in FIG. 3A, the third openings O3 are rectangular and are linearly arranged at the end portion 141 along a direction. The third openings O3 are disposed at the upper surface 1411 and the lower surface 1412 of the end portion 141 in parallel. In this case, the "linearly arranged" third openings O3 are disposed at the same surface (the upper surface 1411 or the lower surface 1412 of the end portion 141), and they are arranged linearly. In addition, the third openings O3 located at the upper surface 1411 of the end portion 141 and the third openings O3 located at the lower surface 1412 of the end portion 141 are parallel to each other, so that the third openings O3 disposed at the upper surface 1411 and the lower surface 1412 can be arranged in parallel. As shown in FIG. 3B, the third openings O3 are circular and are linearly arranged at the end portion 141*a* along a direction. The third openings O3 are disposed at the upper surface 1411 and the lower surface 1412 of the end portion 141*a* in parallel. As shown in FIG. 3C, the third openings O3 of the housing 14*b* are circular and are arranged in a staggered manner at the upper surface 1411 and the lower surface 1412 of the end portion 141*b*. As shown in FIG. 3D, the third openings O3 of the housing 14*c* are long stripes and are linearly arranged at the upper surface 1411 and the lower surface 1412 of the end portion 141*c* in parallel. In this case, the third openings O3 located at the upper surface 1411 of the end portion 141*c* and the third openings O3 located at the lower surface 1412 of the end portion 141*c* are parallel to each other, so that the third openings O3 disposed at the upper surface 1411 and the lower surface 1412 can be arranged in parallel. Of course, the third openings O3 located at the upper surface 1411 of the end portion 141*c* can be parallel to each other, and the third openings O3 located at the lower surface 1412 of the end portion 141*c* can also be parallel to each other. To be noted, the third openings O3 as shown in FIGS. 3A to 3C are rectangular or circular for examples, but the third openings O3 can also be triangular or polygonal (e.g. for example but not limited to pentagon, hexagon, heptagon, octagon, or other known polygons). In addition, although FIGS. 3A to 3D show that the third openings O3 can be formed on the upper surface 1411 and the lower surface 1412 of the end portion 141, 141*a*, 141*b* or 141*c*, it is also possible to form the third openings O3 only on either the upper surface 1411 or the lower surface 1412. The positions of the third openings O3 can be adjusted based on the requirement of the user, and this disclosure is not limited thereto. Moreover, although FIGS. 3A to 3D show that the third openings O3 formed on the same end portion 141, 141*a*, 141*b* or 141*c* have the same shape, it is also possible to form the third openings O3 with different shapes at the same end portion 141, 141*a*, 141*b* or 141*c*. For example, at least one third opening O3 has a shape different from the other third openings O3. The number of the third openings O3 can be adjusted based on the requirement of the user. The size of the third openings O3 can also be adjusted based on the requirement of the user. For example, at least one third opening O3 has a size different from the other third openings O3 (see FIG. 3B), but this disclosure is not limited thereto.

Figure 3E:
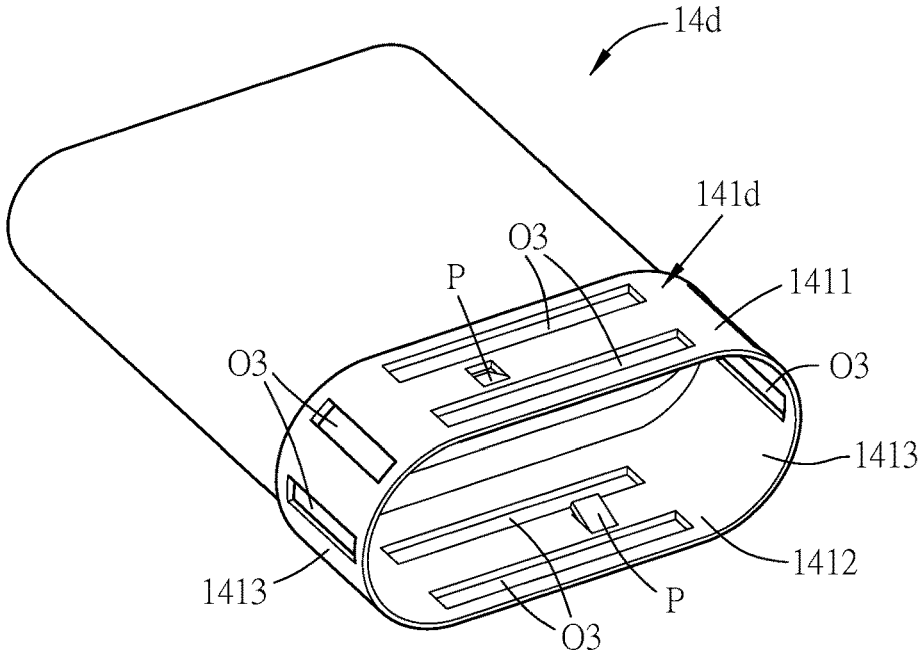

Referring to FIGS. 3D and 3E, in this embodiment, the third openings O3 of the housing 14*c* or 14*d* are long stripes, and these third openings O3 are further disposed on at least one of the two side surfaces 1413 of the end portion 141*c* or 141*d*. The side surfaces 1413 are connected to the upper surface 1411 and the lower surface 1412. To be noted, FIGS. 3D and 3E show that the third openings O3 are formed on both the two side surfaces 1413 of the end portion 141*c* or 141*d*, but the third openings O3 can be formed on either one of the side surfaces 1413 only. This disclosure is not limited thereto.

In this embodiment, as shown in FIG. 3D, the third openings O3 of the housing 14*c* are long stripes, and the extension directions of the third openings O3 are the same. Alternatively, as shown in FIG. 3E, the third openings O3 of the housing 14*d* are long stripes, and the extension directions of the third openings O3 are different. Herein, the extension directions of the third openings O3 are defined by the extension directions of the long axes of the third openings O3. As shown in FIG. 3D, the extension directions of the third openings O3 formed at the end portion 141*c* are the same and are all perpendicular to the long-axis direction of the housing 14*c*. As shown in FIG. 3E, the extension directions of the third openings O3 formed at the end portion 141*d* are different. The extension directions of the third openings O3 formed on the upper surface 1411 and the lower surface 1412 of the end portion 141*d* are perpendicular to the long-axis direction of the housing 14*d*, and the extension directions of the third openings O3 formed on the side surfaces 1413 of the end portion 141*d* are parallel to the long-axis direction of the housing 14*d*. Particularly, at least one third opening O3 has an extension direction different from the other third openings O3, and this disclosure is not limited thereto.

Referring to FIGS. 3A to 3E, in addition to the third openings O3, the end portion 141, 141*a*, 141*b*, 141*c* or 141*d* of the housing 14, 14*a*, 14*b*, 14*c* or 14*d* can be further configured with at least one protrusion P for increasing the friction force between the insulating material 15 and the housing 14, 14*a*, 14*b*, 14*c* or 14*d*. This configuration can enhance the connection between the insulating material 15 and the housing 14, 14*a*, 14*b*, 14*c* or 14*d*, thereby preventing the detachment of the insulating material 15 and the housing 14, 14*a*, 14*b*, 14*c* or 14*d*.

Figure 4A:
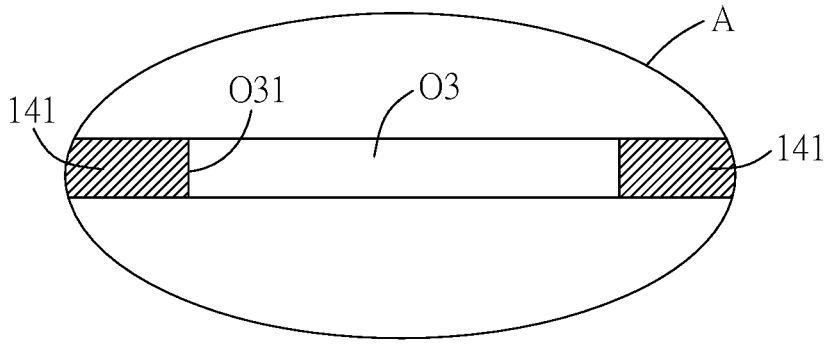
FIGS. 4A and 4B are enlarged views of the region A of FIG. 2A, which show different aspects of the inner wall of the third opening.
Figure 4B:
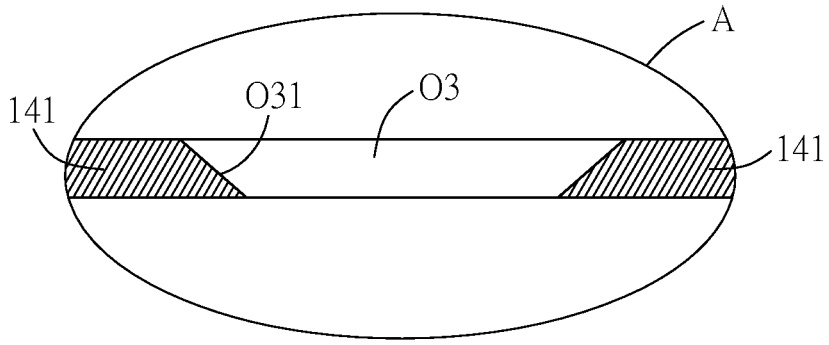
Figure 5:
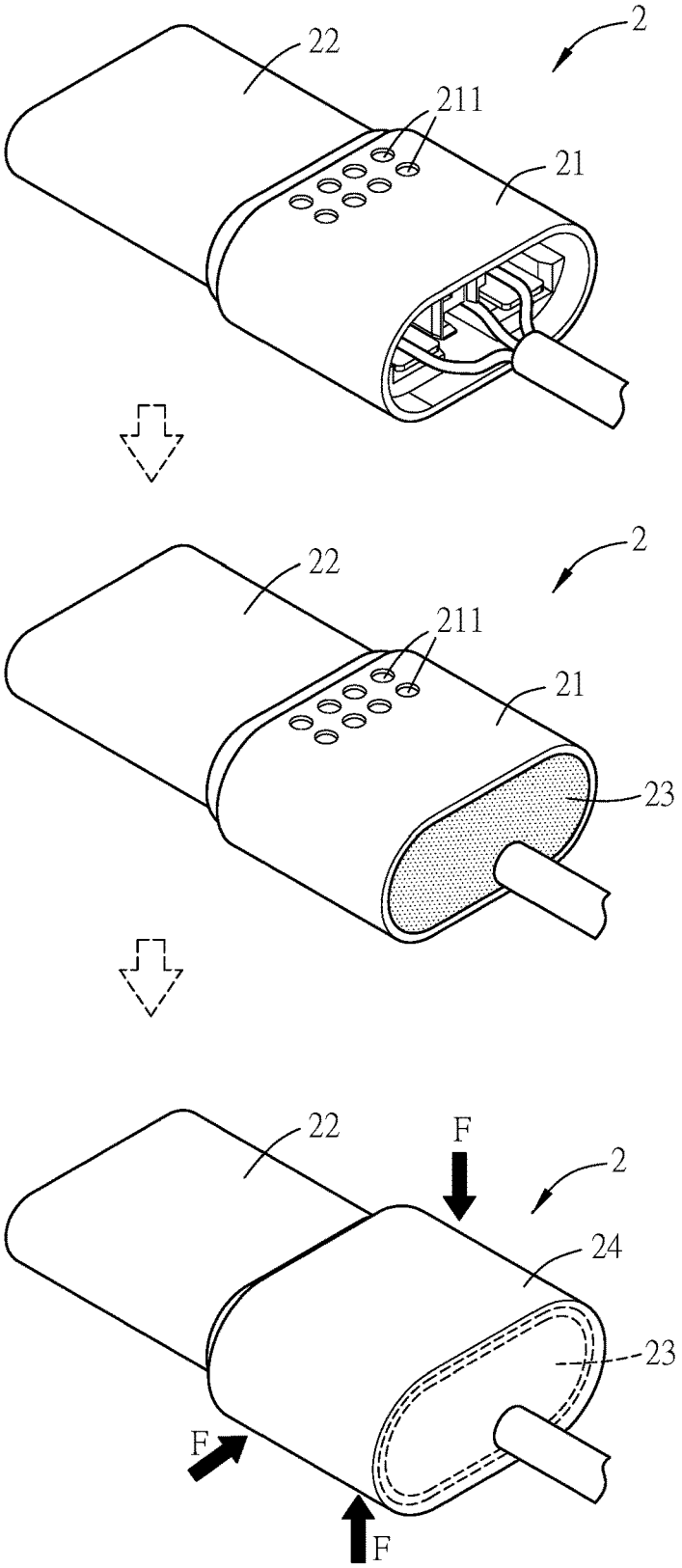
FIG. 5 is a schematic diagram showing the assembling procedure of the conventional connector.

FIGS. 4A and 4B are enlarged views of the region A of FIG. 2A, which show different aspects of the inner wall of the third opening. As shown in FIG. 4A, the inner wall O31 of the third opening O3 is a vertical and planar surface. Alternatively, as shown in FIG. 4B, the inner wall O31 of the third opening O3 is an inclined surface. In other embodiments, sectional views of the inner wall O31 of FIGS. 4A and 4B can be modified from the straight line to a curved line. In other words, the inner wall O31 of the third opening O3 can be a curved surface (not shown). In other embodiments, sectional views of the inner wall O31 of FIGS. 4A and 4B can be modified from the straight line to an irregular line. In other words, the inner wall O31 of the third opening O3 can be a non-planar surface (not shown). The design of the inner wall O31 of the third opening O3 can increase the friction force between the inner wall O31 and the insulating material 15, thereby enhancing the connection between the insulating material 15 and the housing 14 so as to prevent the detachment therebetween.

The assembling procedure of the connector 1 will be described hereinafter with reference to FIGS. 1A to 1D in view of FIGS. 2A to 2C. As shown in FIGS. 1B and 2A, the main body 11, the terminal module 12, the cable module 13 and the housing 14 are provided and assembled. In detailed, a part of the terminal module 12 is disposed inside the main body 11, and a part of the terminal module 12 is disposed adjacent to the second opening O2 of the main body 11 and connected to the main body 11. Then, the connecting portion 131 of the cable module 13 is electrically connected to the pin portion 1213 of the terminal module 12 by, for example but not limited to, welding. Next, the housing 14 is provided to cover the main body 11 and the terminals 1211 of the terminal module 12, and the end portion 141 of the housing 14 is disposed adjacent to the insulating portion 122 of the terminal module 12. Afterwards, as shown in FIGS. 1C, 1D, 2A and 2B, the insulating material 15 is provided by filling or injection molding to cover the end portion 141, the connecting portion 131, the pin portion 1213 and the insulating portion 122, and further to fill the third openings O3 of the end portion 141, thereby enhancing the connection between the insulating material 15 and the end portion 141. Finally, as shown in FIGS. 1A and 2C, the cover skin 16 is provided to cover the insulating material 15 for obtaining a fancy or good looking for the connector 1.

In summary, the housing of the connector of this disclosure is configured with the third openings, so that the insulating material can be filled in the third openings for enhancing the connection between the insulating material and the housing. Accordingly, the manufacturing cost of the connector can be decreased, the production efficiency thereof can be increased, and the reliability thereof can be improved.

Although the disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the disclosure.

What is claimed is:

1. A connector, comprising:

a main body comprising a first opening and a second opening;

a terminal module comprising a terminal portion and an insulating portion, wherein the insulating portion partially covers the terminal portion, the terminal portion comprises a plurality of terminals, a middle portion and a pin portion, the terminals protrude beyond one side of the insulating portion, the middle portion is covered by the insulating portion, the pin portion is exposed from another side of the insulating portion opposite to the side of the insulating portion, the insulating portion is disposed adjacent to the second opening and connected to the main body, and the terminals are disposed in the main body and exposed from the first opening;

a cable module comprising a connecting portion electrically connected to the pin portion;

a housing covering the main body and the terminals, wherein the housing has an end portion disposed adjacent to the insulating portion, and the end portion is configured with a plurality of third openings; and an insulating material covering the end portion, the connecting portion, the pin portion and the insulating portion, and filling the third openings.

2. The connector of claim 1, wherein the insulating portion further comprises a recess portion, and the pin portion is disposed in the recess portion.

3. The connector of claim 2, wherein the insulating material further fills the recess portion.

4. The connector of claim 1, further comprising:

a cover skin covering the insulating material.

5. The connector of claim 1, wherein the third openings are disposed on an upper surface and/or a lower surface of the end portion.

6. The connector of claim 5, wherein the third openings are arranged at the end portion in parallel.

7. The connector of claim 5, wherein the third openings are linearly arranged at the end portion along a direction.

8. The connector of claim 5, wherein the third openings are arranged in a staggered manner at the end portion.

9. The connector of claim 5, wherein the third openings are circular, triangular, rectangular, polygonal, long stripes, or a combination thereof.

10. The connector of claim 9, wherein when the third openings are long stripes, the extension directions of the third openings are the same.

11. The connector of claim 9, wherein at least one of the third openings has a shape, a size, and/or an extension direction different from that of the other third openings.

12. The connector of claim 5, wherein the third openings are further disposed on at least one of two side surfaces of the end portion, and the side surfaces connect to the upper surface and the lower surface.

13. The connector of claim 12, wherein the third openings are arranged at the end portion in parallel.

14. The connector of claim 12, wherein the third openings are linearly arranged at the end portion along a direction.

15. The connector of claim 12, wherein the third openings are arranged in a staggered manner at the end portion.

16. The connector of claim 12, wherein the third openings are circular, triangular, rectangular, polygonal, long stripes, or a combination thereof.

17. The connector of claim 16, wherein when the third openings are long stripes, the extension directions of the third openings are the same.

18. The connector of claim 16, wherein at least one of the third openings has a shape, a size, and/or an extension direction different from that of the other third openings.

* * * * *